US010226791B2

(12) United States Patent
Dardas et al.

(10) Patent No.: US 10,226,791 B2
(45) Date of Patent: Mar. 12, 2019

(54) COLD SPRAY SYSTEM WITH VARIABLE TAILORED FEEDSTOCK CARTRIDGES

(71) Applicant: United Technologies Corporation, Farmington, CT (US)

(72) Inventors: Zissis A. Dardas, Worcester, MA (US); Aaron T. Nardi, East Granby, CT (US); Ying She, East Hartford, CT (US)

(73) Assignee: United Technologies Corporation, Farmington, CT (US)

( * ) Notice: Subject to any disclaimer, the term of this patent is extended or adjusted under 35 U.S.C. 154(b) by 0 days.

(21) Appl. No.: 15/405,970

(22) Filed: Jan. 13, 2017

(65) Prior Publication Data

US 2018/0200755 A1 Jul. 19, 2018

(51) Int. Cl.

| | |
|---|---|
| ***B05B 7/14*** | (2006.01) |
| ***B05B 7/22*** | (2006.01) |
| ***B05D 7/14*** | (2006.01) |
| ***B05B 7/16*** | (2006.01) |
| ***B22F 1/00*** | (2006.01) |
| ***C23C 24/04*** | (2006.01) |
| ***C23C 24/08*** | (2006.01) |

(52) U.S. Cl.

CPC ..... *B05D 7/14* (2013.01); *B05B 7/144* (2013.01); *B05B 7/1686* (2013.01); *B05B 7/22* (2013.01); *B05B 7/228* (2013.01); *B22F 1/0062* (2013.01); *C23C 24/04* (2013.01); *C23C 24/085* (2013.01)

(58) Field of Classification Search

USPC ..... 118/308, 302, 642, 643, 58, 641; 427/180

See application file for complete search history.

(56) References Cited

U.S. PATENT DOCUMENTS

| | | | | |
|---|---|---|---|---|
| 4,789,507 | A * | 12/1988 | Wesley | B29C 47/367 264/176.1 |
| 5,334,235 | A | 8/1994 | Dorfman et al. | |
| 5,534,064 | A * | 7/1996 | Tsutsui | B05B 7/144 118/308 |
| 5,820,678 | A * | 10/1998 | Hubert | C23C 16/4481 118/690 |
| 6,365,222 | B1 | 4/2002 | Wagner et al. | |
| 6,444,259 | B1 | 9/2002 | Subramanian et al. | |
| 6,491,208 | B2 | 12/2002 | James et al. | |
| 6,502,767 | B2 | 1/2003 | Kay et al. | |
| 6,722,584 | B2 | 4/2004 | Kay et al. | |
| 6,780,458 | B2 | 8/2004 | Seth et al. | |
| 6,977,369 | B2 | 12/2005 | Yamaguchi et al. | |

(Continued)

FOREIGN PATENT DOCUMENTS

| | | | | |
|---|---|---|---|---|
| EP | 2942373 | A1 | 11/2015 | |
| GB | 2439934 | A * | 1/2008 | B05B 7/1626 |

(Continued)

OTHER PUBLICATIONS

European Search Report dated May 23, 2018, issued in corresponding European Patent Application No. 18151490.2.

*Primary Examiner* — Yewebdar T Tadesse

(74) *Attorney, Agent, or Firm* — Bachman & LaPointe, P.C.

(57) ABSTRACT

A feedstock cartridge for a cold spray system including at least one powder; and a binder that interconnects at least two particles of the at least one powder.

15 Claims, 4 Drawing Sheets

(56) References Cited

U.S. PATENT DOCUMENTS

| | | | |
|---|---|---|---|
| 7,402,277 | B2 | 7/2008 | Ayer et al. |
| 7,543,764 | B2 | 6/2009 | Haynes et al. |
| 7,560,170 | B2 | 7/2009 | Chellappa |
| 7,582,846 | B2 | 9/2009 | Molz et al. |
| 7,621,466 | B2 | 11/2009 | Ko et al. |
| 7,654,223 | B2 | 2/2010 | Kim et al. |
| 7,836,591 | B2 | 11/2010 | Allen et al. |
| 7,836,593 | B2 | 11/2010 | Allen |
| 7,959,093 | B2 | 6/2011 | Payne |
| 8,020,509 | B2 | 9/2011 | Calla et al. |
| 8,168,289 | B2 | 5/2012 | Seth et al. |
| 8,192,799 | B2 | 6/2012 | Kay et al. |
| 8,282,019 | B2 | 10/2012 | Karimi Esfahani et al. |
| 8,313,042 | B2 | 11/2012 | Vanderzwet et al. |
| 8,349,396 | B2 | 1/2013 | DeBiccari et al. |
| 8,486,249 | B2 | 7/2013 | Almond et al. |
| 8,584,732 | B1 | 11/2013 | Trexler et al. |
| 8,591,986 | B1 | 11/2013 | Ajdelsztajn et al. |
| 8,597,724 | B2 | 12/2013 | Bunting et al. |
| 8,701,590 | B2 | 4/2014 | Kay et al. |
| 8,703,233 | B2 | 4/2014 | Miller et al. |
| 8,783,584 | B2 | 7/2014 | Fukanuma |
| 8,906,450 | B1 | 12/2014 | McInerney et al. |
| 9,095,858 | B2 | 8/2015 | Fukanuma |
| 9,109,291 | B2 | 8/2015 | Lamberton et al. |
| 9,115,421 | B2 | 8/2015 | Ko et al. |
| 9,328,918 | B2 | 5/2016 | Ajdelsztajn et al. |
| 9,394,063 | B2 | 7/2016 | Jackson et al. |
| 9,433,957 | B2 | 9/2016 | Nardi et al. |
| 9,481,933 | B2 | 11/2016 | Mohanty |
| 2007/0065678 | A1* | 3/2007 | Ko ..... C23C 16/4586 428/698 |
| 2015/0315714 | A1* | 11/2015 | Vijay ..... B08B 3/024 205/89 |
| 2015/0321253 | A1 | 11/2015 | Espinal et al. |
| 2016/0279703 | A1 | 9/2016 | Clare et al. |

FOREIGN PATENT DOCUMENTS

| | | | |
|---|---|---|---|
| WO | 2015047545 | A1 | 4/2015 |
| WO | 2015061164 | A1 | 4/2015 |

* cited by examiner

COLD SPRAY SYSTEM WITH VARIABLE TAILORED FEEDSTOCK CARTRIDGES

BACKGROUND

The present disclosure relates to a cold spray system and, more particularly, to material feedstock cartridges therefor.

Cold spray, also often referred to as dynamic solid state deposition or kinetic spray, is a process that uses compressed gas to accelerate powdered materials through a supersonic nozzle toward a substrate. The powder particles impact the substrate and consolidate through a process of plastic deformation. This plastic flow creates a cold weld between the incoming powder particles and the substrate.

Methods have been developed to increase the plastic flow to increase both the bond to the substrate as well as the deposit quality via layered application of peening material powders systems. The layers can be achieved in a production environment with several powder feeders, each with different blended powder compositions and a mechanism that switches between powders. In some instances, the blended powders do not settle and striate in the feeder such that inconsistent powders blends are sprayed. This may complicate effective application, as peening material powders may be as much as twice the diameter of the metal powder particles, which may decrease the deposit quality.

Cold spray systems have the benefit of being portable, which readily facilitates field repairs. However, the ability to properly maintain blend ratios and multiple feeders may complicate use in such field repairs.

SUMMARY

A feedstock cartridge for a cold spray system according to one disclosed non-limiting embodiment of the present disclosure can include at least one powder; and a binder that binds at least two particles of the at least one powder to form a feedstock cartridge.

A further embodiment of the present disclosure may include, wherein the binder is at least one of a wax, Polyvinylpyrrolidone (PVP), Poly(vinyl alcohol) (PVOH, PVA, or PVAl).

A further embodiment of the present disclosure may include, wherein the binder vaporizes at less than about 150 degree C.

A further embodiment of the present disclosure may include, wherein the binder completely covers each particle of the at least one powder.

A further embodiment of the present disclosure may include, wherein the binder partially covers each particle of the at least one powder.

A further embodiment of the present disclosure may include, wherein the feedstock cartridge includes a multiple of powders.

A further embodiment of the present disclosure may include, wherein each of the multiple of powders are intermixed in at least one layer defined by the feedstock cartridge.

A further embodiment of the present disclosure may include, wherein one of the multiple of powders form a gradient from a first end of the feedstock cartridge to an opposite end of the feedstock cartridge.

A further embodiment of the present disclosure may include, wherein at least one of the multiple of powders is a peening material.

A cold spray system according to one disclosed non-limiting embodiment of the present disclosure can include a material feed hopper to receive a feedstock cartridge of at least one powder and a binder; and a desolidifier downstream of the material feed hopper to at least partially desolidify a portion of the feedstock cartridge.

A further embodiment of the present disclosure may include, wherein the desolidifier includes an auger that grinds off a portion of the feedstock cartridge.

A further embodiment of the present disclosure may include, wherein the desolidifier includes a laser that melts away at the feedstock cartridge.

A further embodiment of the present disclosure may include, wherein the laser is operable to vaporize the binder.

A further embodiment of the present disclosure may include, wherein the material feed hopper includes a feed mechanism to drive the feedstock cartridge toward the desolidifier.

A further embodiment of the present disclosure may include a heater downstream of the desolidifier to receive the portion of the feedstock cartridge and vaporize the binder.

A further embodiment of the present disclosure may include, wherein the heater includes a heated coil to vaporize the binder and communicate the at least one powder to a spray gun.

A method for manufacturing a feedstock cartridge according to one disclosed non-limiting embodiment of the present disclosure can include coating particles of at least one powder with a binder to bind the particles; and forming a feedstock cartridge from the coated particles.

A further embodiment of the present disclosure may include coating the particles of a first powder; coating the particles of a second powder; and mixing the coated particles of the first and second powder in a desired ratio.

A further embodiment of the present disclosure may include, introducing the binder as a vapor.

A further embodiment of the present disclosure may include introduced the binder as a liquid with a solvent.

The foregoing features and elements may be combined in various combinations without exclusivity, unless expressly indicated otherwise. These features and elements as well as the operation thereof will become more apparent in light of the following description and the accompanying drawings. It should be understood, however, the following description and drawings are intended to be exemplary in nature and non-limiting.

BRIEF DESCRIPTION OF THE DRAWINGS

Various features will become apparent to those skilled in the art from the following detailed description of the disclosed non-limiting embodiment. The drawings that accompany the detailed description can be briefly described as follows.

DETAILED DESCRIPTION

Figure 1:
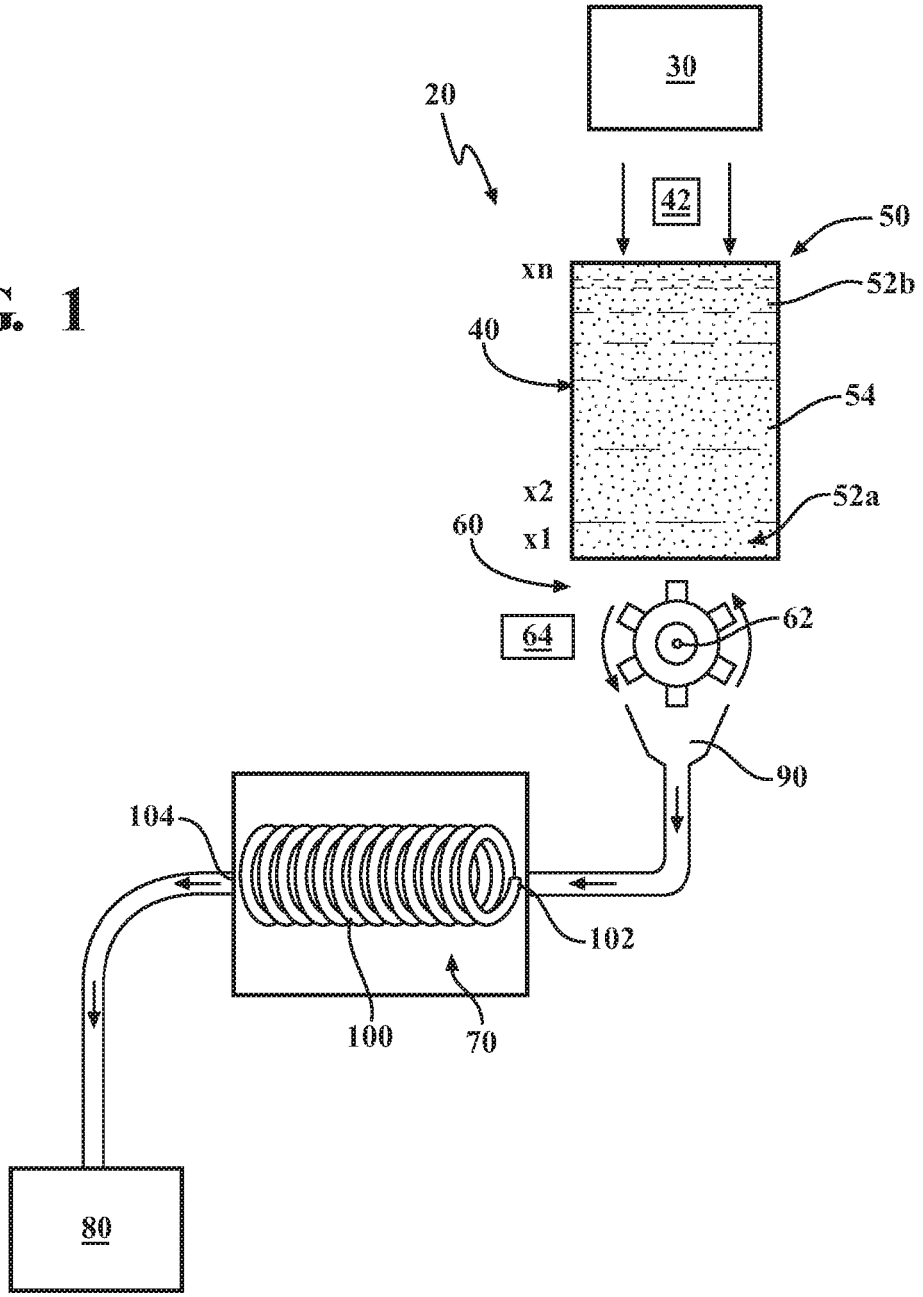
FIG. 1 is a schematic view of an exemplary embodiment of a cold spray system.

FIG. 1 schematically illustrates a cold spray system 20. As used herein the term "cold spray" refers to a materials deposition process in which relatively small particles (ranging in size, without limitation, from 5 to 500 micrometers (μη) in diameter) are accelerated to high velocities (typically, but without limitation, 300 to 1200 meters/second), at a relatively low temperatures (100-500° C.) gas stream to develop a coating or deposit by impact upon a substrate. Various terms such as "kinetic energy metallization," "kinetic metallization," "kinetic spraying," "high-velocity powder deposition," and "cold gas-dynamic spray method have been used to refer to this technique.

The cold spray system 20 generally includes a motive gas system 30, a material feed hopper 40 that receives a feedstock cartridge 50, a desolidifier 60, a heater 70, and a spray gun 80. The motive gas system 30 is in fluid communication with the material feed hopper 40, the desolidifier 60, the heater 70, and the spray gun 80.

Feedstock powder particles that are in the feedstock cartridge 50 are communicated via the inert gas from the motive gas system 30 for introduction into the spray gun 80 to accelerate the gas. Various pressurized inert gases can be used in the cold spray technique to include but not be limited to helium or nitrogen. The subsequent high-velocity impact of the particles onto a substrate disrupts the oxide films on the particle and substrate, which presses their atomic structures into intimate contact with one another under momentarily high interfacial pressures and temperatures.

The feedstock cartridge 50 includes one or more powders 52A, 52B, . . . 52*n* that are coated and solidified via a binder 54 to form a self-contained unit that may be specifically tailored to a particular application process. The binder 54 may be a wax, Polyvinylpyrrolidone (PVP), Poly(vinyl alcohol) (PVOH, PVA, or PVAl) and/or other materials that vaporize at a relatively low temperature, e.g., less than about 150 degrees C. and more specifically about 120 degrees C.

In one embodiment, the feedstock cartridge 50 provides functionally graded materials of the one or more powders 52A, 52B, . . . , 52*n* in a "stick" form. The particles of the one or more powders 52A, 52B, . . . , 52*n* are essentially interconnected, or bound together, by the binder 54. The binder 54 can be continuous, i.e. covering completely each powder particle or patchy, i.e. only partially covering each powder particle, but in either case, the metal powder particles are bound within each layer as well as to maintain the different layers together.

In one example, the first powder 52A is located in a bottom layer X1 of the feedstock cartridge 50 which is sprayed first and the second powder 52B is located at a top layer Xn of the feedstock cartridge 50. The powder composition of the example of the feedstock cartridge 50 then gradually changes, for example, from 100% first powder 52A in the bottom layer X1 to 100% second powder 52B in the top layer Xn. The gradual change may be formed via a multiple of layers X2, X3, etc. That is, each layer may include a gradual change in mixture between the first powder 52A and the second powder 52B, e.g., 100% first powder 52A at X1, 90% first powder 52A with 10% second powder 52B at the next layer X2, 80% first powder 52A and 20% second powder 52B at the next layer X3, etc., until 100% second powder 52B is obtained at the top layer Xn. It should be appreciated that various other gradients as well as more than two powders may be utilized for a particular feedstock cartridge 50 such that each feedstock cartridge 50 is tailored for a particular application. Further, each feedstock cartridge 50 may be tailored for a particular application and for a particular coverage area. That is, a feedstock cartridge 50 that is to be used for a smaller coverage area will have a different layer thickness in each layer for a feedstock cartridge 50 that is predefined for a larger coverage area.

In another example, the first powder 52A may be a "peening material" which grades out during the buildup of the second powder 52B as the layers progress through the feedstock cartridge 50. In this example, the first powder 52A is spherical chrome carbide nickel chrome peening particles and the second powder 52B is nickel. The graded out composition provides a hard phase of 75% by weight peeing material that may result in a weak bond between the nickel and the stainless steel due to significant work hardening of the nickel. Then to reinforce the bond, a third layer of 25% peening material may follow a second layer of 50% peening material, etc.

The desolidifier 60 selectively removes portions of the feedstock cartridge 50 for communication through a conduit 90 to the heater 70. In one embodiment, the desolidifier 60 is a mechanical auger that grinds away at the feedstock cartridge 50 at a predetermined rate to feed the powder composition into the conduit 90. The conduit 90 may at least partially encase the desolidifier 60 to collect the portions of the feedstock cartridge 50 as well as provide for communication of the inert gas from the motive gas system 30.

In one embodiment, the desolidifier 60 can include an auger 62 with a rough texture to grind off, or break away, portions of the cartridge 50. That is, the desolidifier 60 may rotate at a specified rate to control the material feed rate, such that a specified quantity of the feedstock cartridge 50 is removed as "chunks" into the conduit 90. The auger 62 may alternatively, or additionally, be heated to begin melting of the binder 54. The material feed hopper 40 may include a feed mechanism 42 such as a spring or other such transport device to drive the feedstock cartridge 50 toward the desolidifier 60 at a predetermined, or otherwise adjustable, rate.

In another embodiment, the desolidifier 60 includes a laser 64 that selectively melts an end of the feedstock cartridge 50 at a predetermined rate to feed the powder composition into the conduit 90. The laser 64 may be of a relatively low enough power to avoid damage to the powder 52 but is high enough to at least partially vaporize the binder 54 such that the inert gas from the motive gas system 30 need not be heated by the heater 70 prior to communication to the spray gun 80. Alternatively, the laser 64 allows the powder to break away from the feedstock cartridge 50 and permit the inert gas to communicate the powder 52 and binder 54 composition to the heater 70.

The heater 70 includes a heated conduit coil 100 that completely vaporizes the binder 54 and heats the inert gas from the motive gas system 30. The temperature of the heater 70, the length of the heated conduit coil 100, and the flow rate of the pre-heated inert gas flowing therethrough may be selected so that a residence time between an entrance 102 and an exit 104 of the heated conduit coil 100 assures the binder 54 is vaporized into the gas phase. These process conditions assure that the binder 54 transitions from the solid phase to the liquid phase, then to the superheated gas phase. In addition, the parameters are selected so that pyrolysis of the binder 54 to lower molecular weight hydrocarbon species and elemental carbon has been eliminated or minimized as, for most applications, inclusion of carbon phases in the cold spray is to be avoided. However, should inclusion of carbon microparticles or carbon nanoparticles be desirable, the process conditions can be tailored to achieve the desired carbon concentration by the binder pyrolysis reactions. If the carbon formed by pyrolysis is sufficiently small, on the order of nanometers, the carbon will have insufficient mass to pass through the bow shock from the gun 80 and deposit with the powder 52 such that some pyrolysis may be acceptable.

The binder 54 protects the powder 52 from air and moisture oxidation during transportation, storage, and use. The binder 54 enhances powder flow due to insulation from a potential electrical charge in the powder 52.

Figure 2:
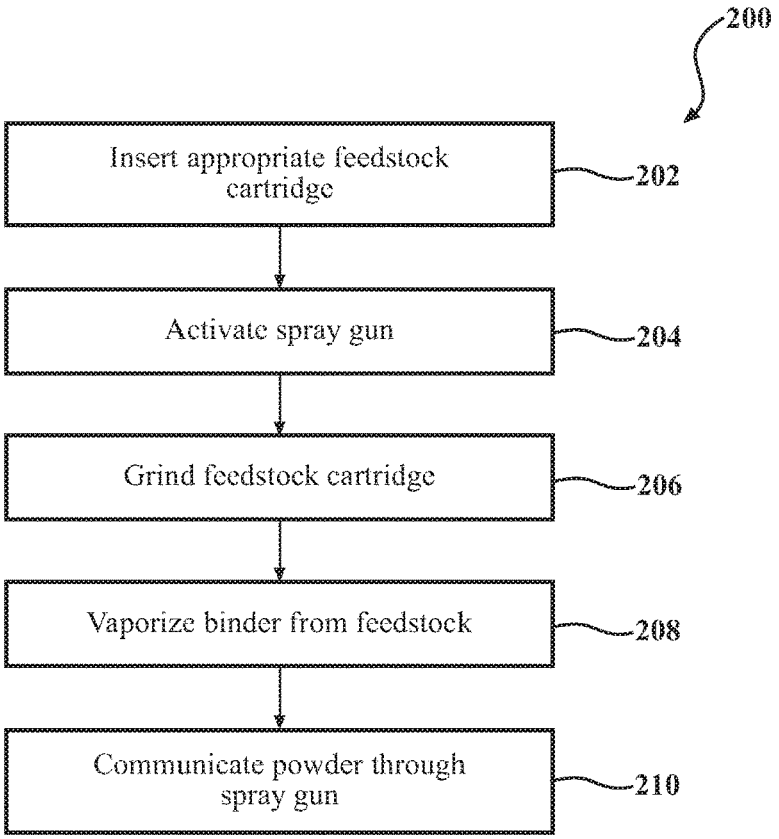
FIG. 2 is a process flow diagram of an exemplary embodiment of a cold spray method.

With reference to FIG. 2, one method 200 for operating the cold spray system 20 includes inserting a feedstock cartridge 50 into the material feed hopper 40 (step 202). The feedstock cartridge 50 is selected based on the desired application. When the spray gun 80 is operated, the desolidifier 60 selectively grinds or melts away at the feedstock cartridge 50 for communication to the heater 70 via the inert gas from the motive gas system 30 (step 204). The heater 70 then completely vaporizes the binder 54 from the powder 52 (step 206). From the heater 70, the powder 52 is communicated through the spray gun 80 for mechanical interlocking and metallurgical bonding from re-crystallization at highly strained particle interfaces (step 208).

Figure 3:
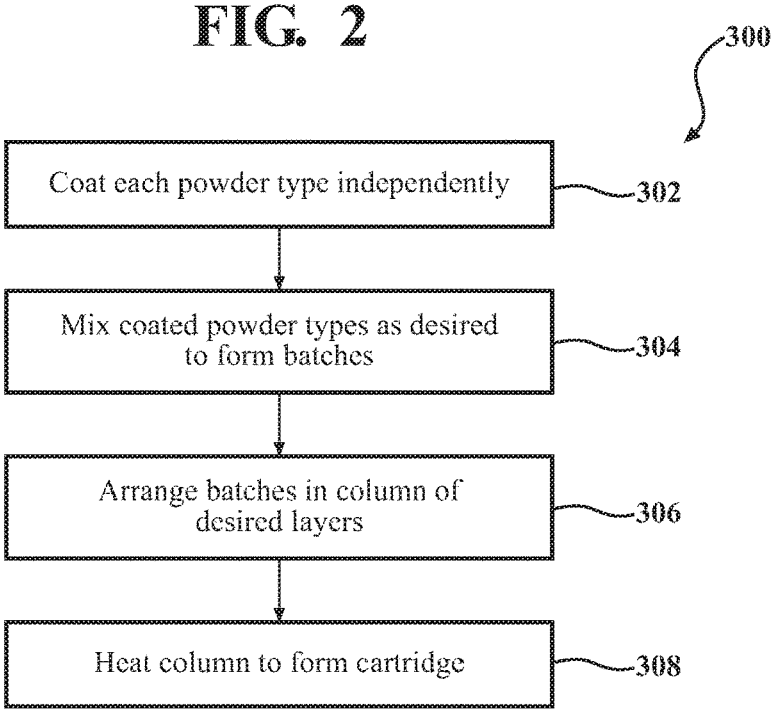
FIG. 3 is a process flow diagram of an exemplary embodiment of a feedstock manufacturing cartridge.

With reference to FIG. 3, another method 300 for manufacturing the feedstock cartridge 50 initially includes introduction of the binder 54 as a vapor into a fluidized bed that contains the powder 52. In this method, each powder is coated independently as different batches, i.e. one batch for powder 52A, and another batch for powder 52B, etc., (step 302). After cooling of the batches, the binder coated powders are mixed in a separate operation to the prescribed compositions (step 304). In one example, individual compositions of, for example, 90% of the first powder 52A and 10% of the second powder 52B (by weight or volume) are mixed together to form a metal powder composition. Therefore, batches with different metal powder chemical compositions are achieved. These powders are then arranged in a column mold of layers of the desired metal compositions and layer thicknesses (step 306). Then, once the desirable powder metal feed columns are arranged, the column mold is heated such that the metal particles in the columns are fixed into place as defined by the mold to form the feedstock cartridge 50 (step 308). The binder 54 thereby fixes in place the layers in the feedstock cartridge 50.

Figure 4:
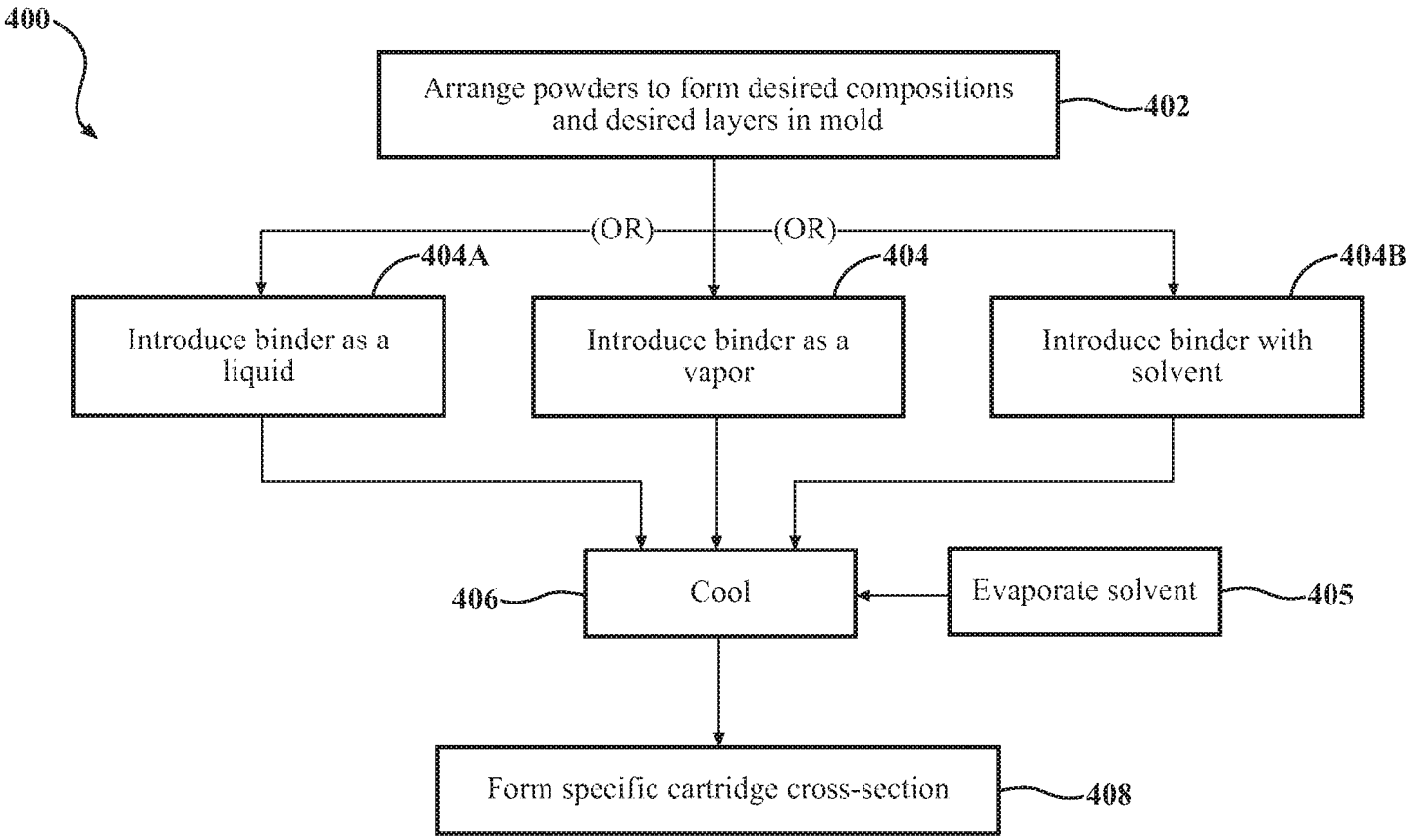
FIG. 4 is a process flow diagram of an exemplary embodiment of a feedstock manufacturing cartridge with alternatives.

With reference to FIG. 4, another method 400 for manufacturing the feedstock cartridge 50 initially includes the arrangement of powders 52A, 52B, . . . 52*n* in a mold (step 402). The powders 52A, 52B, . . . 52*n* form a composition and thickness per the desired distribution. The binder 54 is then introduced as a vapor to flow through the particles the arrangement of powders 52A, 52B, . . . 52*n* (step 404) and the temperature distribution is controlled so that the binder 54 covers and coats the particles of the powders. When the desired binder 54 coating is achieved on the powders 52A, 52B, . . . 52*n*, the composition is cooled down (step 406), and cartridges 50 of specific cross section (step 408) are cut to feed the material feed hopper 40.

Alternatively, the binder 54 is then introduced as a molten liquid (step 404A) to flow through the particles the arrangement of powders 52A, 52B, . . . 52*n* via pump or other pressurization system.

Alternatively, the binder 54 is introduced as a liquid with a solvent to flow through the arrangement of powders 52A, 52B, . . . 52*n* via a pump or other pressurization system (step 404B, step 405). The solvent is then evaporated leaving a coating of binder 54 on the arrangement of powders 52A, 52B, . . . 52*n*. The binder 54 may also be recovered downstream by cooling the solvent vapor for re-use.

Figure 5:
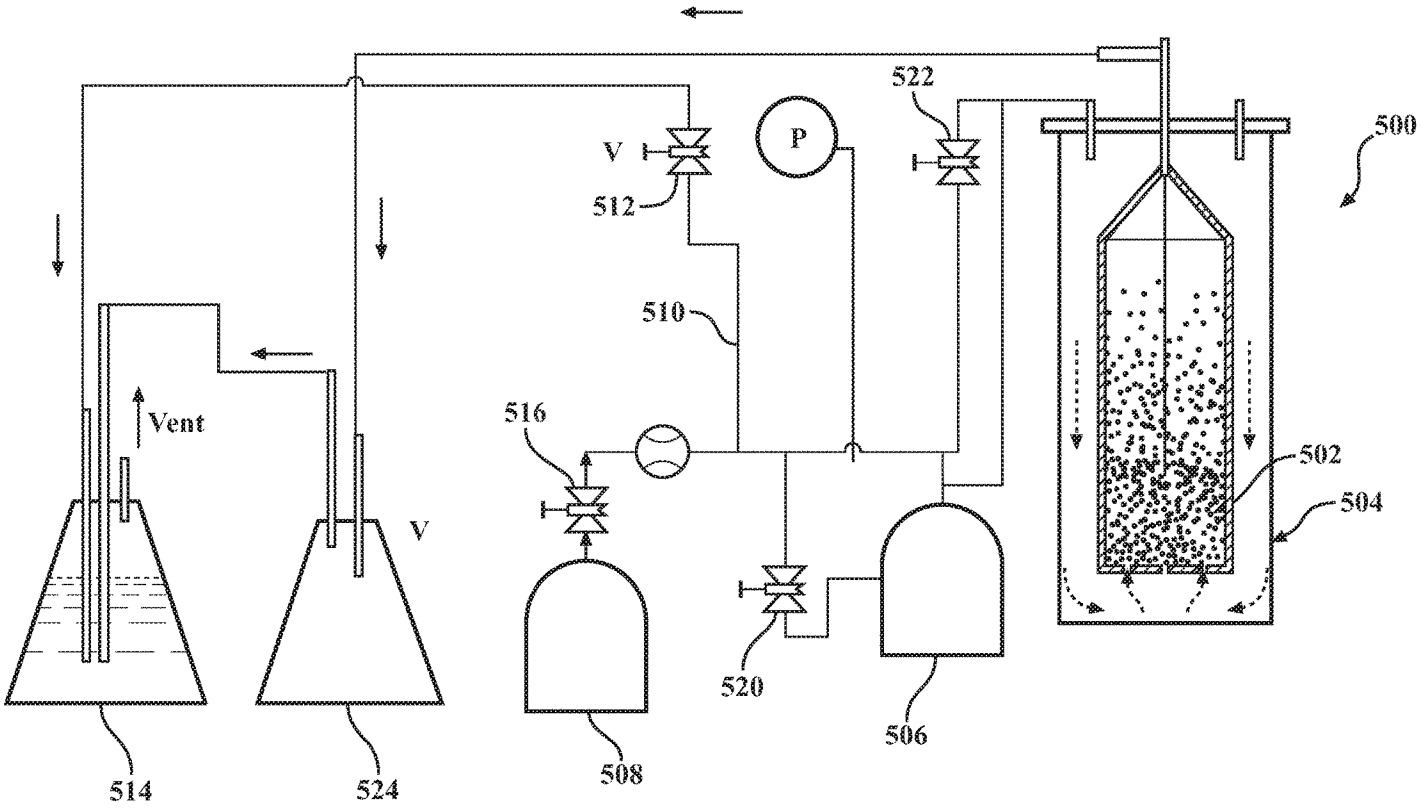
FIG. 5 is a schematic view of an exemplary embodiment of a fluidized bed system to coat powder particles with a binder.

With reference to FIG. 5, a fluidized bed system 500 that may be utilized to coat the powder 52 with a binder 54 so as to form the cartridge 50 therefrom generally includes a fluidized bed 502 in a tubular furnace 504 that receives the binder 54 from a binder source 506. The powder 52 is loaded into the fluidized bed 502 and an inert fluidization gas such as N2 from a gas source 508 is introduced to the fluidized bed 502. The used inert fluidization gas is ultimately collected by flowing the gas first through a bleed line 510 via valve 512 then to a liquid bubbler 514 for collection. To avoid a flow surge once the gas source valve is opened, the gas is directed via valve 516 and closing valve 512 to the fluidized bed 502 at the flow rate through the mass flow controller 518 to fluidize the powders inside the fluidized bed 50.

The binder vapor is carried to the fluidized bed 502 by the fluidization gas via closing the valve 520 and opening valve 522. The temperature of the fluidized bed 502 is maintained at temperatures lower than solidification temperatures of the binder 54 in the fluidization gas stream, so the powders 52 in the fluidized bed 502 are coated with the binder 54 and collected in the powder collector 524.

The use of the terms "a" and "an" and "the" and similar references in the context of description (especially in the context of the following claims) are to be construed to cover both the singular and the plural, unless otherwise indicated herein or specifically contradicted by context. The modifier "about" used in connection with a quantity is inclusive of the stated value and has the meaning dictated by the context (e.g., it includes the degree of error associated with measurement of the particular quantity). All ranges disclosed herein are inclusive of the endpoints, and the endpoints are independently combinable with each other. It should be appreciated that relative positional terms such as "forward," "aft," "upper," "lower," "above," "below," and the like are with reference to the normal operational attitude of the vehicle and should not be considered otherwise limiting.

Although the different non-limiting embodiments have specific illustrated components, the embodiments of this invention are not limited to those particular combinations. It is possible to use some of the components or features from any of the non-limiting embodiments in combination with features or components from any of the other non-limiting embodiments.

It should be appreciated that like reference numerals identify corresponding or similar elements throughout the several drawings. It should also be appreciated that although a particular component arrangement is disclosed in the illustrated embodiment, other arrangements will benefit herefrom.

Although particular step sequences are shown, described, and claimed, it should be understood that steps may be performed in any order, separated or combined unless otherwise indicated and will still benefit from the present disclosure.

The foregoing description is exemplary rather than defined by the limitations within. Various non-limiting embodiments are disclosed herein, however, one of ordinary skill in the art would recognize that various modifications and variations in light of the above teachings will fall within the scope of the appended claims. It is therefore to be appreciated that within the scope of the appended claims, the disclosure may be practiced other than as specifically described. For that reason the appended claims should be studied to determine true scope and content.

The invention claimed is:

1. A cold spray system, comprising:

a material feed hopper to receive a feedstock cartridge of at least one powder and a binder;

a desolidifier downstream of the material feed hopper to at least partially desolidify a portion of the feedstock cartridge;

a heater downstream of the desolidifier to receive the portion of the feedstock cartridge and vaporize the binder; and a spray gun downstream of the heater to spray the at least one powder.

2. The system as recited in claim 1, wherein the desolidifier includes an auger that grinds off a portion of the feedstock cartridge.

3. The system as recited in claim 1, wherein the desolidifier includes a laser that melts away at the feedstock cartridge.

4. The system as recited in claim 3, wherein the laser is operable to vaporize the binder.

5. The system as recited in claim 1, wherein the material feed hopper includes a feed mechanism to drive the feedstock cartridge toward the desolidifier.

6. The system as recited in claim 1, wherein the heater includes a heated coil to vaporize the binder.

7. The system as recited in claim 1, wherein the at least one powder is communicated from the spray gun in particles that are from 5 to 500 micrometers (μιη) in diameter at velocities from 300 to 1200 meters/second, and at a temperature of between 100-500° C.

8. The system as recited in claim 1, wherein the binder is at least one of a wax, Polyvinylpyrrolidone (PVP), Poly (vinyl alcohol) (PVOH, PVA, or PVAl).

9. The system as recited in claim 1, wherein the binder vaporizes at less than about 150 degree C.

10. The system as recited in claim 1, wherein the binder completely covers each particle of the at least one powder.

11. The system as recited in claim 1, wherein the binder partially covers each particle of the at least one powder.

12. The system as recited in claim 1, wherein the feedstock cartridge includes a multiple of powders.

13. The system as recited in claim 12, wherein each of the multiple of powders are intermixed in at least one layer defined by the feedstock cartridge.

14. The system as recited in claim 12, wherein one of the multiple of powders form a gradient from a first end of the feedstock cartridge to an opposite end of the feedstock cartridge.

15. The system as recited in claim 12, wherein at least one of the multiple of powders is a peening material.

* * * * *